US006515413B1

(12) United States Patent
New et al.

(10) Patent No.: US 6,515,413 B1
(45) Date of Patent: Feb. 4, 2003

(54) INFRARED FILTER SYSTEM FOR FLUORESCENT LIGHTING

(75) Inventors: Richard D. New, Plano, TX (US); Robert L. Burgess, Arlington, TX (US)

(73) Assignee: Luminator Holding, LP, Plano, TX (US)

( * ) Notice: Subject to any disclaimer, the term of this patent is extended or adjusted under 35 U.S.C. 154(b) by 0 days.

(21) Appl. No.: 09/296,921

(22) Filed: Apr. 22, 1999

(51) Int. Cl.[7] ..... H01J 63/04; H01J 5/12

(52) U.S. Cl. ..... 313/493; 313/112; 313/17; 313/489

(58) Field of Search ..... 313/25, 17, 26, 313/27, 47, 110–113, 491–93, 488–490, 634–35, 607; 427/106, 126.3, 107, 10; 349/62, 64; 362/339; 315/125, 127, 158–59, 208

(56) References Cited

U.S. PATENT DOCUMENTS 4,017,758 A * 4/1977 Almer et al. ..... 313/112
4,112,331 A * 9/1978 Verbeek et al. ..... 315/125
4,792,716 A * 12/1988 Walsh ..... 313/113
4,916,352 A * 4/1990 Haim et al. ..... 313/493 X
5,610,469 A * 3/1997 Bergman et al. ..... 313/25
6,067,188 A * 5/2000 Zieba et al. ..... 313/112 X

* cited by examiner

*Primary Examiner*—Michael H. Day
*Assistant Examiner*—Mack Haynes
(74) *Attorney, Agent, or Firm*—Jenkins & Gilchrist PC

(57) ABSTRACT

A method and apparatus that effectively filters infrared light from fluorescent lighting and that is easily adapted to typical fluorescent lighting and assemblies. A transparent tube is provided for receiving a fluorescent lamp wherein the transparent tube includes a first end, a second end, an inner surface and an outer surface. An infrared block is located adjacent to the inner surface of the transparent tube. Furthermore, a first cap is provided for capping the first end of the transparent tube and a second cap is provided for capping the second end of the transparent tube.

27 Claims, 2 Drawing Sheets

INFRARED FILTER SYSTEM FOR FLUORESCENT LIGHTING

BACKGROUND OF THE INVENTION

1. Field of the Invention

The present invention relates to light filter systems and more particularly, but not by way of limitation, to infrared light filter systems for fluorescent lighting.

2. Description of the Problem and the Related Art

Existing night vision systems collect light that cannot be seen by the human eye and focus that light on an image intensifier. Inside the image intensifier, a photo cathode absorbs the collected light energy and converts it into electrons. These electrons are then drawn through a micro-channel plate (which multiplies the electrons thousands of times) to a phosphor screen. When the multiplied electrons strike the phosphor screen, they cause the screen to emit light that the human eye can see. Because the phosphor screen emits light in exactly the same pattern and degrees of intensity as the collected light, the bright, nighttime image viewable on the phosphor screen corresponds precisely to the outside scene being viewed.

The night vision industry has progressed through three stages or "generations": generation I, II and III. Although generation I technology is generally obsolete, generations II and III are in widespread use. Generation II technology, for instance, intensifies light up to 20,000 times, which means that this technology is effective in ¼ moonlight. The newest technology, generation III technology, however, provides a substantially higher intensification than does generation II technology. Furthermore, generation III technology, unlike generation I and II, is sensitive to near-infrared light, i.e., light in the 600–900 nanometer region. The ability of generation III technology to intensify light at and near the infrared region is important because most natural backgrounds reflect infrared light more readily than visible light. Thus, when infrared reflectance differences between discernable objects are maximized, viewing contrast increases and potential terrain hazards and other objects are distinguishable. Generation III technology's infrared capabilities complement this phenomenon and, accordingly, produce a sharp, informative image of an otherwise unviewable nighttime scene.

Furthermore, generation III technology can be modified to incorporate filters that substantially block visible light. These types of systems, known as aviator night vision systems, amplify light only in the near infrared and infrared region. Thus, aviator night vision systems allow the user to more clearly view terrain hazards and the like without interference from visible light.

Aviator night vision systems are useful in environments containing generated light such as light generated by an incandescent bulb. For example, a pilot of a search and rescue helicopter can require night vision capabilities to locate victims at night. The pilot needs to see not only the terrain being searched, but also the lighted helicopter instrument display. Furthermore, others aboard the helicopter may need internal lighting to perform their individual tasks, e.g., navigation. With standard generation III technology, the pilots ability to see the terrain would be greatly hampered by the visible light produced by the display and the lights used by others in the helicopter. In other words, standard generation III technology can pick-up and intensify the relatively high-intensity visible light produced inside the helicopter rather than pick-up and intensify the relatively low-intensity light on the surrounding terrain. In fact, in many cases the standard generation III night vision system could become momentarily inoperable because too much visible light reaches the collector and in effect, shuts down the entire night vision system. The pilot is thus left to fly blind or at least without night vision capabilities. Either option is likely unacceptable.

Aviator night vision systems, unlike standard generation III technology, filter out the visible light and leave only infrared light to stimulate the viewable phosphor screen. Accordingly, the visible light produced by displays or other lights inside the helicopter will not interfere with aviator night vision systems. The pilot wearing an aviator night vision system, thus, can watch the night terrain and attempt to locate victims without interference from visible light produced inside the helicopter.

Light sources, however, generally produce both visible light and infrared light. Thus, the helicopter display and any other light source used in the helicopter can produce infrared light that will interfere with even aviator night vision systems. For most light sources, however, infrared light can be filtered out, thereby minimizing its affect on aviator night vision systems. For example, existing displays and incandescent bulbs can be filtered so that the emit very little infrared light. Thus, if a search and rescue helicopter was equipped with infrared filtered lighting, the pilot could use an aviator night vision system without interference from the lighted display or any other internal lighting.

Although infrared light can be filtered from many light sources, infrared light, has not previously been effectively filtered from conventional type fluorescent lighting. Accordingly, an invention is needed that effectively filters infrared light from fluorescent lighting. Furthermore, an invention is needed that effectively filters infrared light from fluorescent lighting and that is easily adapted to typical flourescent lighting and assemblies. One skilled in the art can appreciate that such an invention would have application anywhere that night vision systems are used or anywhere that infrared needs to be blocked. For example, the present invention even can be used to prevent the detection of fluorescent lights by night vision systems.

SUMMARY OF THE INVENTION

To remedy the deficiencies of existing systems and methods, the present invention provides a method and apparatus that effectively filters infrared light from fluorescent lighting and that is easily adapted to typical fluorescent lighting and assemblies.

One exemplary embodiment of the present invention includes a transparent tube for receiving a fluorescent lamp wherein the transparent tube includes a first end, a second end, an inner surface and an outer surface. This embodiment further includes an infrared block located adjacent to the inner surface of the transparent tube. The infrared block is for substantially blocking infrared light from passing through the transparent tube. Furthermore, this embodiment includes a first cap for capping the first end of the transparent tube and a second cap for capping the second end of the transparent tube.

BRIEF DESCRIPTION OF THE DRAWINGS

Various objects and advantages and more complete understanding of the present invention will become apparent and more readily appreciated by reference both to the following Detailed Description and to the appended claims when taken in conjunction with the accompanying Drawings wherein:

DETAILED DESCRIPTION

Figure 1A:
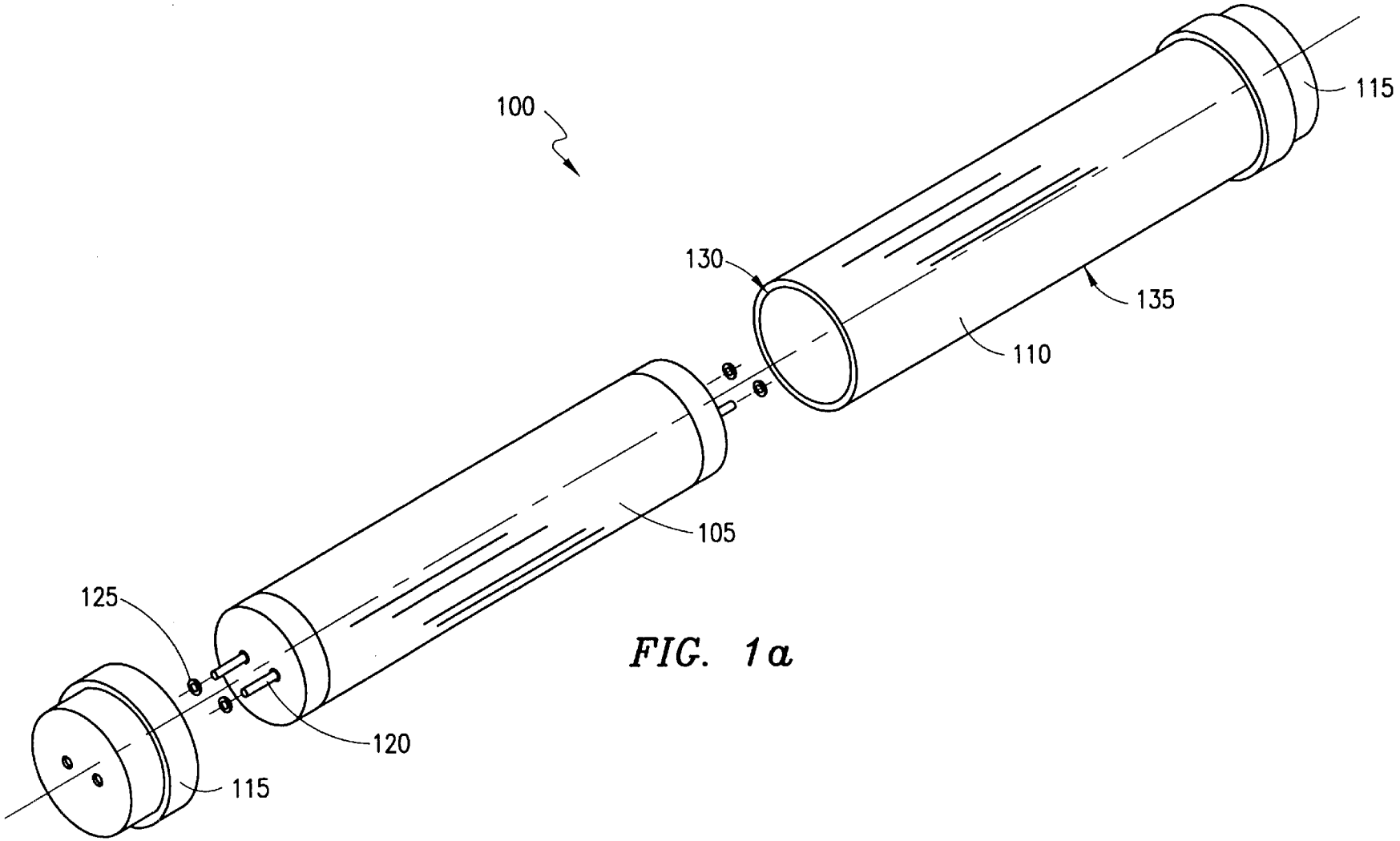
FIG. 1*a* is an exploded, frontal perspective view of an exemplary filter assembly in accordance with the present invention.

Although the present invention is open to various modifications and alternative constructions, preferred exemplary embodiments shown in the drawings are described herein in detail. It is to be understood, however, that there is no intention to limit the invention to the particular forms disclosed. One skilled in the art can recognize that there are numerous modifications, equivalences and alternative constructions that fall within the spirit and scope of the invention as expressed in the claims.

Accordingly, to overcome the deficiencies of existing technology and to fill a long-felt commercial need, the present invention provides an effective infrared filter for fluorescent lighting. Furthermore, the present invention provides an effective infrared filter for fluorescent lighting that is easily adapted to typical fluorescent lighting. Additionally, the present invention can filter light in accordance with MIL Specification MIL-L-85762A, which is incorporated herein by reference.

Referring now to FIG. 1*a*, there is illustrated an exploded, frontal perspective view of an exemplary filter assembly 100 in accordance with the present invention. The filter assembly 100 includes a transparent, cylindrical tube 110 with a diameter and length slightly greater than those of the fluorescent tube 105, which can be of any size or type. The filter assembly also includes a cap 115 placed on each end of the tube 110. Although both caps 115 may be removable, it is only necessary that one cap 115 be removable. As long as one cap 115 is removable, that cap 115 can be removed and the fluorescent tube 105 can be inserted into or removed from the tube 110. Furthermore, if one cap 115 is not removable, that cap 115 can be used to properly align the fluorescent tube 105 once placed inside tube 110.

Each cap 115 is perforated to receive the electrical contacts 120 of the fluorescent tube 105. The electrical contacts 120 pass through the cap 115 and can engage the electrical connections of a fluorescent fixture (not shown). Gaskets 125 are placed between the caps 115 and the ends of the fluorescent tube 105 and prevent light from escaping through the perforations in the cap 115. Furthermore, the gaskets 125 can slide over the electrical contacts 120 and thereby form a very effective light seal.

Because of the light seal formed by the caps 115 and the gaskets 125, all light generated by the fluorescent tube 105 must pass through the tube 110. However, a filter layer 130 (which can be flexible) is located between the tube 110 and the fluorescent tube 105. Therefore, all light produced by the fluorescent tube 105 must pass through the filter layer 130 where infrared light and near infrared light produced by the fluorescent tube 105 are blocked. Thus, all light emitted from the filter assembly 100 will be essentially infrared free and will not interfere with aviator night vision systems.

The filter assembly 100 can also include an opaque light blocker 135 that is preferably made of a scratch resistant material. The opaque light blocker 135 focuses the light emitted by the fluorescent tube 105 into a particular pattern. Furthermore, the opaque light blocker 135 can prevent light emitted from the filter assembly 100 from striking particular objects. For example, the opaque light blocker 135 can prevent light emanating from the filter assembly 100 from striking the interior portion of the fluorescent fixture (not shown) holding the filter assembly. Directing light away from the interior portion of a fluorescent fixture is important because even the filtered light emanating from filter assembly 100 will generate infrared light if it strikes red paint. Although the interior of most fluorescent fixtures are painted white, most white paint contains traces of red that can reflect infrared light. Thus, the opaque light blocker 135 can prevent the filtered light from striking areas, such as the interior of a fluorescent fixture, that will reflect infrared light and interfere with aviator night vision systems.

As can be appreciated, the present invention permits typical fluorescent lamps to easily and quickly be converted to only emit infrared-free light. For example, a typical fluorescent tube 105 can be converted to a non-infrared light emitting fluorescent source by merely removing one of the caps 115 from the tube 110. Next, gaskets such as gaskets 125 are placed over the electrical contacts 120 on both ends of the fluorescent tube 105. The fluorescent tube is then inserted into the tube 110 and aligned so that the electrical contacts 120 pass through the perforations in the non-removed cap 115. Next, the previously-removed cap 115 is placed onto the tube 110 such that the electrical contacts 120 pass through the perforations in the cap 115. Finally, the entire filter assembly, including the fluorescent tube, can be inserted into a standard fluorescent fixture.

Figure 1B:
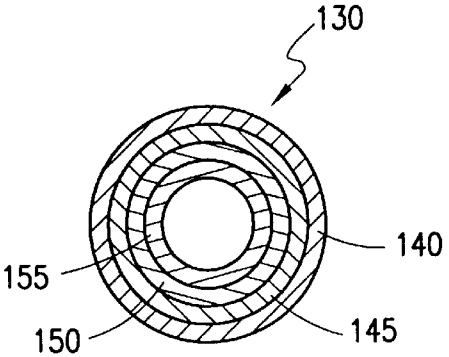
FIG. 1*b* is a cross-sectional view of a filter layer used with the filter assembly of FIG. 1*a;*

Referring now to FIG. 1*b* there is illustrated a cross-sectional view of a filter layer 130 used with the filter assembly 100 of FIG. 1*a*. The filter layer 130 can include four individual layers, all of which can be flexible. Going from outside to inside, the layers are green filter 140, infrared block 145, green filter 150 and green filter 155. Because infrared block 145 can be sensitive to heat, in this embodiment, it is not placed directly adjacent to the fluorescent tube 105.

Furthermore, the individual filter layers do not necessarily need to cover the entire surface area of the tube 105 as is illustrated in FIGS. 1*a* and 1*b*. Rather, in one embodiment, particular ones or even all of the layers of filter layer 130 cover only that portion of the tube 110 that is not covered by the opaque light blocker 135.

Although particularly good results have been obtained by using the above-described four layers, a significant portion of infrared light produced by the fluorescent tube 105 can be blocked by using just the infrared block 145 and either one green filter or two green filters, which can be various shades of green, such as green filter 155. Furthermore, although any effective infrared block can be used with the present invention, particularly good results have been obtained by using infrared block number 577-1086 produced by Hoffman Engineering, which is located at 22 Omega Drive, 8 Riverbend Center, P.O. Box 4430, Stamford, Conn. 06907-0430.

Green filter layers, such as green filter layer 155, can be added or removed to alter the transmission characteristics of filter assembly 100. As one skilled in the art can appreciate, if more light should be emitted, a green filter layer can be removed. Alternatively, if less light should be emitted, an additional green filter layer can be added. Furthermore, the transmission characteristics of the filter assembly 100 can also be altered by changing the size of the opaque light blocker 135. For example, if the opaque light blocker 135 is enlarged to cover 75% of the outside surface area of the tube 110, less light will be emitted than when the opaque light blocker 135 only covers 50% of the outside surface area of the tube 110.

In another embodiment of the present invention, the multiple layers of filter layer 130 are combined so is that the same filtering and transmission properties can be obtained with a single layer filter or at least fewer layers. Furthermore, the filter layer 130 can be eliminated as a distinct element by incorporating the properties of the filter layer directly with the tube 110. In this embodiment, the infrared block and transmission reducers, if necessary, are formed directly into the tube 110.

Figure 2:
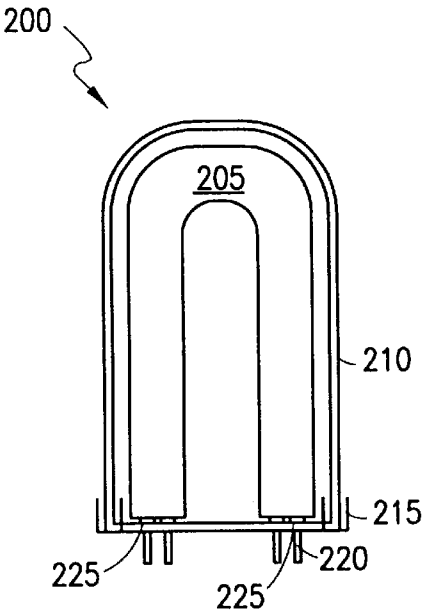
FIG. 2 illustrates a frontal view of an alternate embodiment of a filter assembly in accordance with the present invention.

Referring now to FIG. 2, there is illustrated a frontal view of an alternate embodiment of a filter assembly in accordance with the present invention. This embodiment includes a filter assembly 200 that filters infrared light from fluorescent tube 205. The filter assembly 200 includes a transparent cover 210 that fits over the fluorescent tube 205. The filter assembly 200 also includes a cap 215 (which can be opaque or clear) that is perforated to receive the electrical connectors 220 of the fluorescent tube 205. The electrical connectors 220 pass through the cap 215 and thereby can engage a fluorescent fixture (not shown). Gaskets. 225 prevent unfiltered light from escaping through the perforations in the cap 215.

Additionally, the cover 210 can include an integrated infrared filter and transmission reducer (not shown). Alternatively, a flexible filter layer similar to filter layer 130 of FIG. 1 can be placed between the fluorescent tube 205 and the cover 210.

Figure 3:
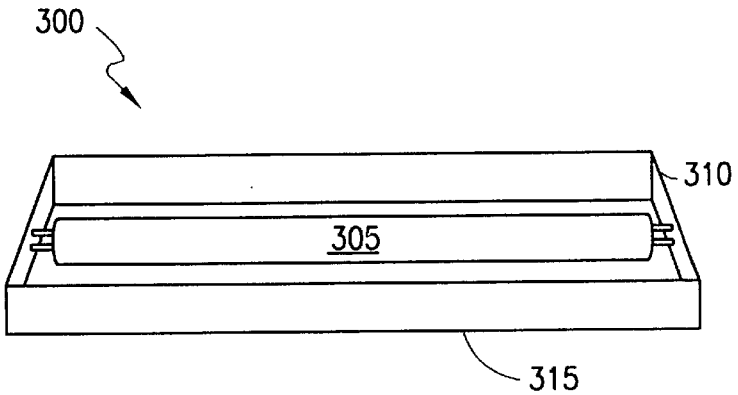
FIG. 3 illustrates a frontal view of a fluorescent fixture including a filter cover in accordance with the present invention.

Referring now to FIG. 3, there is illustrated a frontal view of a fluorescent fixture including a filter cover in accordance with the present invention. This embodiment includes a fluorescent fixture 300 such as would be suspended from a ceiling. The fluorescent fixture 300 includes a base 310 for receiving the fluorescent tube 305 and a cover 315 for blocking the infrared light generated by the fluorescent tube 305.

The cover 315 comprises an integrated infrared filter and, if needed, an integrated transmission reducer. For example, the cover 315 can be formed of a plastic or plastic-type material that incorporates infrared filters and transmission reducers. Alternatively, a filter layer, such as filter layer 130 (shown in FIG. 1) or an equivalent single layer, can be attached to the cover 315 such that the fluorescent fixture 300 emits only filtered light.

In summary, the present invention provides an effective infrared filter for fluorescent lighting. Furthermore, the present invention provides an effective infrared filter for fluorescent lighting that is easily adapted to typical fluorescent lighting. Additionally, the present invention can filter light in accordance with MIL Specification MIL-L-85762A.

Those skilled in the art can readily recognize that numerous variations and substitutions may be made in the invention, its use and its configuration to achieve substantially the same results as achieved by the exemplary embodiments described herein. Accordingly, there is no intention to limit the invention to the disclosed exemplary forms. Many variations, modifications and alternative constructions will fall within the scope and spirit of the disclosed invention as expressed in the claims.

What is claimed is:

1. A light filter system for filtering light emitted by a fluorescent lamp having an electrical connector, the system comprising:

a transparent tube for receiving the fluorescent lamp, the transparent tube including a first end and a second end, the transparent tube further including an inner surface and an outer surface;

an infrared block located adjacent to the inner surface of the transparent tube, the infrared block for substantially blocking infrared light from passing through the transparent tube;

a projection block located adjacent to the outer surface of the tube, the projection block for blocking light generated by the fluorescent lamp;

a first cap for capping the first end of the transparent tube; and a second cap for capping the second end of the transparent tube.

2. The system of claim 1, wherein the projection block is an opaque material.

3. The system of claim 1, wherein the first cap is perforated to receive the electrical connector of the fluorescent lamp, the system further comprising:

a light seal engagable with the first cap and the electrical connector, the light seal for preventing light generated by the fluorescent lamp from passing through the perforation of the first cap.

4. The system of claim 1, wherein the infrared block comprises:

an infrared filter substrate; and a green substrate located adjacent to the infrared filter substrate;

wherein the infrared filter substrate and the green substrate substantially block infrared light generated by the fluorescent lamp.

5. The system of claim 1, further comprising:

a transmission reduction layer for reducing the amount of light transmission from the fluorescent lamp, the transmission reduction layer located adjacent to the infrared block.

6. The system of claim 5, wherein the transmission reduction layer includes a green filter layer.

7. The system of claim 1, wherein the infrared block comprises:

a flexible infrared filter located generally adjacent the inner surface of the tube; and a flexible colored filter located adjacent the flexible infrared filter;

wherein the flexible infrared filter is located between inner surface of the tube and the flexible colored filter.

8. The system of claim 7, wherein the flexible colored filter comprises a flexible green filter.

9. The system of claim 1, wherein the infrared block is integrated with the tube.

10. The system of claim 1, wherein at least one of the first cap and the second cap comprise a removable cap.

11. The system of claim 1, wherein the infrared block comprises:

an infrared filter substrate; and a colored substrate located adjacent to the infrared filter substrate;

wherein the infrared filter substrate and the colored substrate substantially block infrared light generated by the fluorescent lamp.

12. The system of claim 1, wherein the projection block is integrated with the tube.

13. A light filter system for filtering light emitted by a fluorescent source having an electrical connector, the system comprising:

a cover means for covering a fluorescent source, the cover means including a first end and a second end, the cover means further including an inner surface and an outer surface;

an infrared block means located adjacent to the inner surface of the cover means, the infrared block means for substantially blocking infrared light from passing through the cover means, wherein the infrared block means comprises:

an infrared filter means; and a colored filter means located adjacent to the infrared filter means; and wherein the infrared filter means and the colored filter means substantially block infrared light generated by the fluorescent source;

a first cap means for capping the first end of the cover means; and a second cap means for capping the second end of the cover means.

14. The system of claim 13, further comprising a projection block means for blocking light generated by the fluorescent source.

15. The system of claim 13, wherein the first cap means is perforated to receive the electrical connector of the fluorescent source, the system further comprising:

a light seal means engagable with the first cap means and the electrical connector, the light seal means for preventing light generated by the fluorescent source from passing through the perforation of the first cap means.

16. The system of claim 13, further comprising:

a transmission reduction means for reducing the amount of light transmission from the fluorescent source, the transmission reduction means located adjacent the infrared block means.

17. The system of claim 13, wherein the infrared block means is integrated with the cover means.

18. The system of claim 13, wherein at least one of the first cap means and the second cap means comprise a removable cap means.

19. A light filter system for filtering light emitted by a fluorescent lamp having an electrical connector, the system comprising:

a transparent tube for receiving the fluorescent lamp, the transparent tube including a first end and a second end, the transparent tube further including an inner surface and an outer surface;

an infrared block located adjacent to the inner surface of the transparent tube, the infrared block for substantially blocking infrared light from passing through the transparent tube;

a transmission reduction layer for reducing the amount of light transmission from the fluorescent lamp, the transmission reduction layer located adjacent to the infrared block;

a first cap for capping the first end of the transparent tube; and a second cap for capping the second end of the transparent tube.

20. The system of claim 19, further comprising a projection block for blocking light generated by the fluorescent lamp.

21. The system of claim 20, wherein the projection block is an opaque material.

22. The system of claim 19, wherein the first cap is perforated to receive the electrical connector of the fluorescent lamp, the system further comprising:

a light seal engagable with the first cap and the electrical connector, the light seal for preventing light generated by the fluorescent lamp from passing through the perforation of the first cap.

23. The system of claim 19, wherein the infrared block comprises:

an infrared filter substrate; and a green substrate located adjacent to the infrared filter substrate;

wherein the infrared filter substrate and the green substrate substantially block infrared light generated by the fluorescent lamp.

24. The system of claim 19, wherein the transmission reduction layer includes a green filter layer.

25. The system of claim 19, wherein the infrared block comprises:

a flexible infrared filter located generally adjacent the inner surface of the tube; and a flexible colored filter located adjacent the flexible infrared filter;

wherein the flexible infrared filter is located between inner surface of the tube and the flexible colored filter.

26. The system of claim 19, wherein the infrared block is integrated with the tube.

27. The system of claim 19, wherein at least one of the first cap and the second cap comprise a removable cap.

* * * * *

UNITED STATES PATENT AND TRADEMARK OFFICE

CERTIFICATE OF CORRECTION

PATENT NO. : 6,515,413 B1 
DATED : February 4, 2003
INVENTOR(S) : Richard D. New and Robert L. Burgess It is certified that error appears in the above-identified patent and that said Letters Patent is hereby corrected as shown below:

Title page,
Item [74], *Attorney, Agent, or Firm*, delete "Jenkins" and replace with -- Jenkens --

Column 2,
Line 37, delete "flourescent" and replace with -- fluorescent --

Column 5,
Line 25, delete "." between "Gaskets" and "225"

Signed and Sealed this

Third Day of June, 2003

JAMES E. ROGAN
*Director of the United States Patent and Trademark Office*